US009171439B2

(12) United States Patent
Yeager et al.

(10) Patent No.: US 9,171,439 B2
(45) Date of Patent: Oct. 27, 2015

(54) METHOD AND APPARATUS FOR POWERING A SECURITY DEVICE

(75) Inventors: Lawrence R. Yeager, Matthews, NC (US); Lee H. Eckert, Waxhaw, NC (US); Gary Mark Shafer, Charlotte, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 262 days.

(21) Appl. No.: 13/541,246

(22) Filed: Jul. 3, 2012

(65) Prior Publication Data

US 2013/0009770 A1 Jan. 10, 2013

Related U.S. Application Data

(60) Provisional application No. 61/504,857, filed on Jul. 6, 2011.

(51) Int. Cl.

| | |
|---|---|
| ***G08B 29/00*** | (2006.01) |
| ***G08B 13/24*** | (2006.01) |
| ***G08B 29/04*** | (2006.01) |

(52) U.S. Cl.

CPC ..... *G08B 13/2402* (2013.01); *G08B 29/04* (2013.01)

(58) Field of Classification Search

CPC ..... G08B 29/04; G08B 13/1463; G08B 13/1454; G08B 13/2402; E05B 47/00; E05B 2047/0059; E05B 2047/0057

USPC ..... 340/506, 545.2, 545.6, 568.4, 568.8, 340/571, 568.2, 568.1, 539.1, 572.1, 572.8, 340/572.9

See application file for complete search history.

(56) References Cited

U.S. PATENT DOCUMENTS

| | | | | |
|---|---|---|---|---|
| 4,870,391 | A * | 9/1989 | Cooper | 340/572.5 |
| 5,280,273 | A * | 1/1994 | Goldstein | 340/632 |
| 5,561,417 | A * | 10/1996 | Rothbaum et al. | 340/568.2 |
| 5,861,807 | A * | 1/1999 | Leyden et al. | 340/568.2 |
| 6,020,819 | A * | 2/2000 | Fujiuchi et al. | 340/571 |
| 7,518,510 | B2 * | 4/2009 | Kojo | 340/568.1 |
| 7,522,047 | B2 * | 4/2009 | Belden et al. | 340/568.1 |
| 2005/0168320 | A1 * | 8/2005 | Henderson et al. | 340/5.25 |
| 2009/0079566 | A1 * | 3/2009 | Goldstein et al. | 340/568.1 |
| 2010/0176945 | A1 * | 7/2010 | Fawcett et al. | 340/568.1 |
| 2010/0301998 | A1 * | 12/2010 | Marszalek et al. | 340/5.65 |
| 2012/0169453 | A1 * | 7/2012 | Bryla et al. | 340/3.1 |

* cited by examiner

*Primary Examiner* — Anh V La

(57) ABSTRACT

A security apparatus and method for protecting merchandise items is presented. In the preferred embodiment, a merchandise security device includes a housing with an access door that has an open position and a closed position, a primary power source, a secondary power source and alarm system. The alarm system determines when a voltage of the primary power source drops below a threshold value. When the voltage drops below the threshold value, the alarm system switches to the secondary power source for its power. When the alarm system is in a standby mode, it will not generate alarms when operating on the secondary power source. However, when the alarm system has not been placed into a standby mode, the alarm system will generate alarms when operating on the secondary power source and the access door is in the open position.

21 Claims, 11 Drawing Sheets

METHOD AND APPARATUS FOR POWERING A SECURITY DEVICE

CROSS-REFERENCE TO RELATED APPLICATION

This application claims priority from U.S. Provisional Application Ser. No. 61/504,857, filed Jul. 6, 2011, the disclosure of which is incorporated herein by reference.

BACKGROUND OF THE INVENTION

1. Field of Invention

This invention relates to anti-theft devices for items of merchandise. More particularly, this invention relates to a security device powered with electrical power. Specifically, this invention relates to a security device having a primary power source and a secondary power source that backs up the primary power source and still allows the security device to activate and alarm when the primary power source fails.

2. Background Information

Heretofore, there have existed many product independent anti-theft devices intended to secure a wide range of commercial products. For example, electronic article surveillance (EAS) tags may be placed inside a box, adhered onto a product, or placed within the pages of a book. To defeat the EAS tag, an individual would only have to remove it from the product. As a natural consequence, anti-theft devices have evolved to include devices which secure the EAS tag to the product while also protecting the tag from tampering and removal. These devices incorporate attachment mechanisms which are simultaneously difficult for a thief to remove yet easy for a checkout clerk to remove when supplied with the right key. At present, many anti-theft devices are generally "one size fits all" and product independent. Furthermore, present anti-theft devices require a key or code to unlock the anti-theft device adding complexity and time to the checkout process.

Other more complex security device can be armed with electronic sensors to detect when the security device is tampered with or removed from an item of merchandise. For example, electronic cable types wherein cables wrap around a box containing merchandise or through a portion of the merchandise to lock the security device to the merchandise. When one of the cables is cut or removed while the device is armed it will sound an alarm. However, these more complex type security devices require electrical power, often in the form of a battery. To defeat these types of electronic protection devices, a thief can remove screws from a door covering a battery that powers the device. Once the door is opened, the battery can be quickly removed to disable the device. Because of flaws in current anti-theft devices, better anti-theft devices are desired.

SUMMARY OF THE INVENTION

The preferred embodiment of the invention includes a merchandise protection device. The merchandise protection device includes a housing with an access door that has an open position and a closed position, a primary power source, a secondary power source and alarm system. The access door can be simply opened (without needed any tools) to allow the primary power supply to be changed. For example, the door may contain a simple finger tab that can be pressed to allow the access door to be opened. The alarm system determines when a voltage of the primary power source drops below a threshold value. When the voltage drops below the threshold value, the alarm system switches to the secondary power source for its power. When the alarm system is in a standby mode, it will not generate alarms when operating on the secondary power source. However, when the alarm system has not been placed into a standby mode, the alarm system will generate alarms when operating on the secondary power source and the access door is in the open position.

In another embodiment, the merchandise protection device is associated with a key. When the key is in the proximity of the merchandise protection device, a sensor on the merchandise protection device will place it into the standby mode.

In other configurations of the preferred embodiment, the merchandise protection device includes a lock to prevent the access door from being opened by unauthorized personnel. When the lock is unlocked, the access door can be opened allowing access to the primary power source.

In one configuration of the preferred embodiment, the primary power source is a battery and the secondary power source is a capacitor.

BRIEF DESCRIPTION OF SEVERAL VIEWS OF THE DRAWINGS

One or more preferred embodiments that illustrate the best mode(s) are set forth in the drawings and in the following description. The appended claims particularly and distinctly point out and set forth the invention.

The accompanying drawings, which are incorporated in and constitute a part of the specification, illustrate various example methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
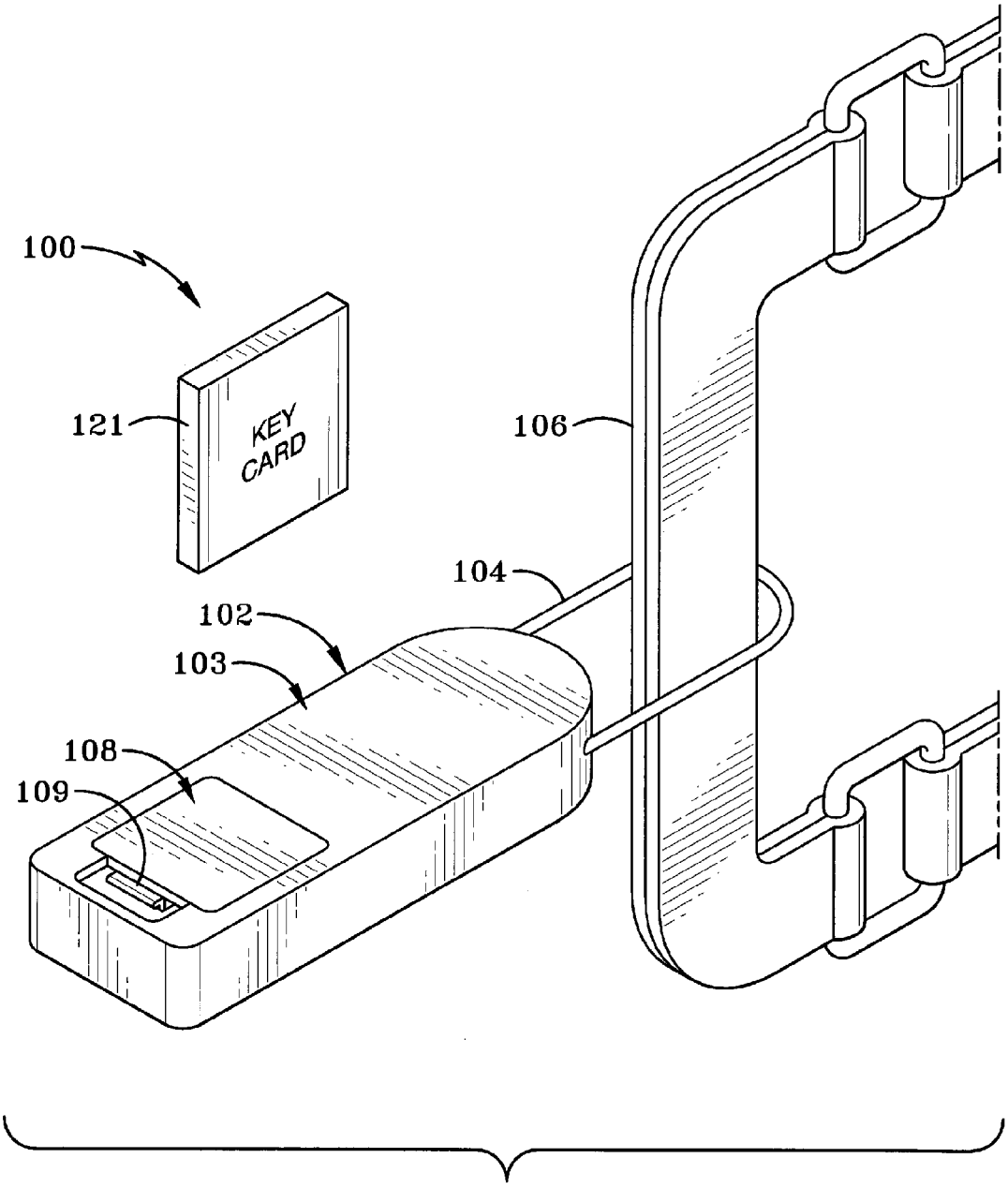
FIG. 1 is a perspective view showing the invention embodied in a cable-lock type of security device.
Figure 2:
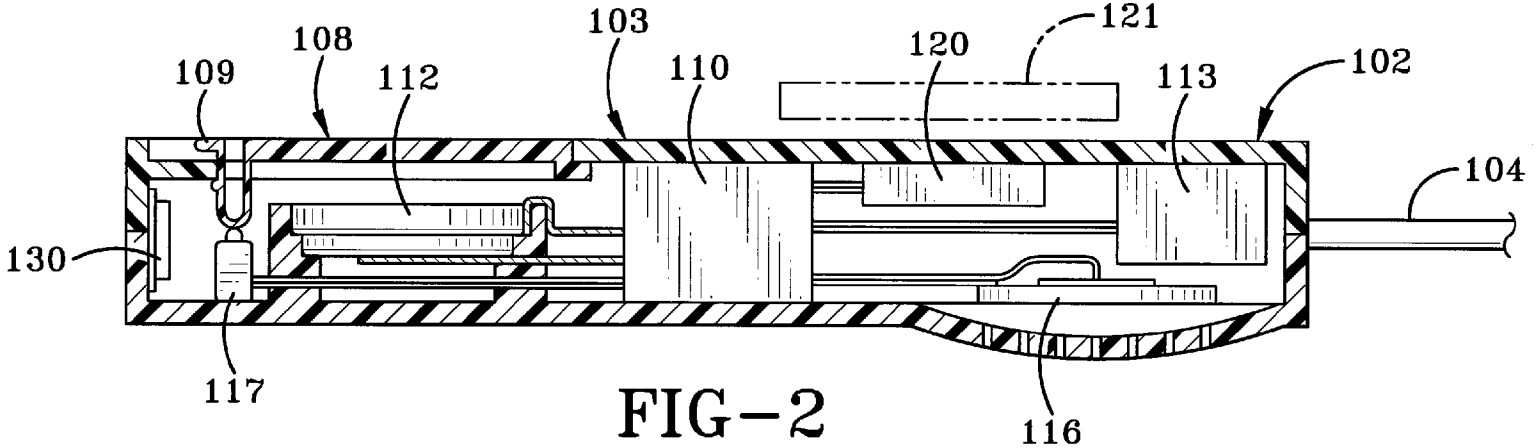
FIG. 2 is a sectional view of the cable-lock of FIG. 1 with the access door in the closed position.
Figure 3:
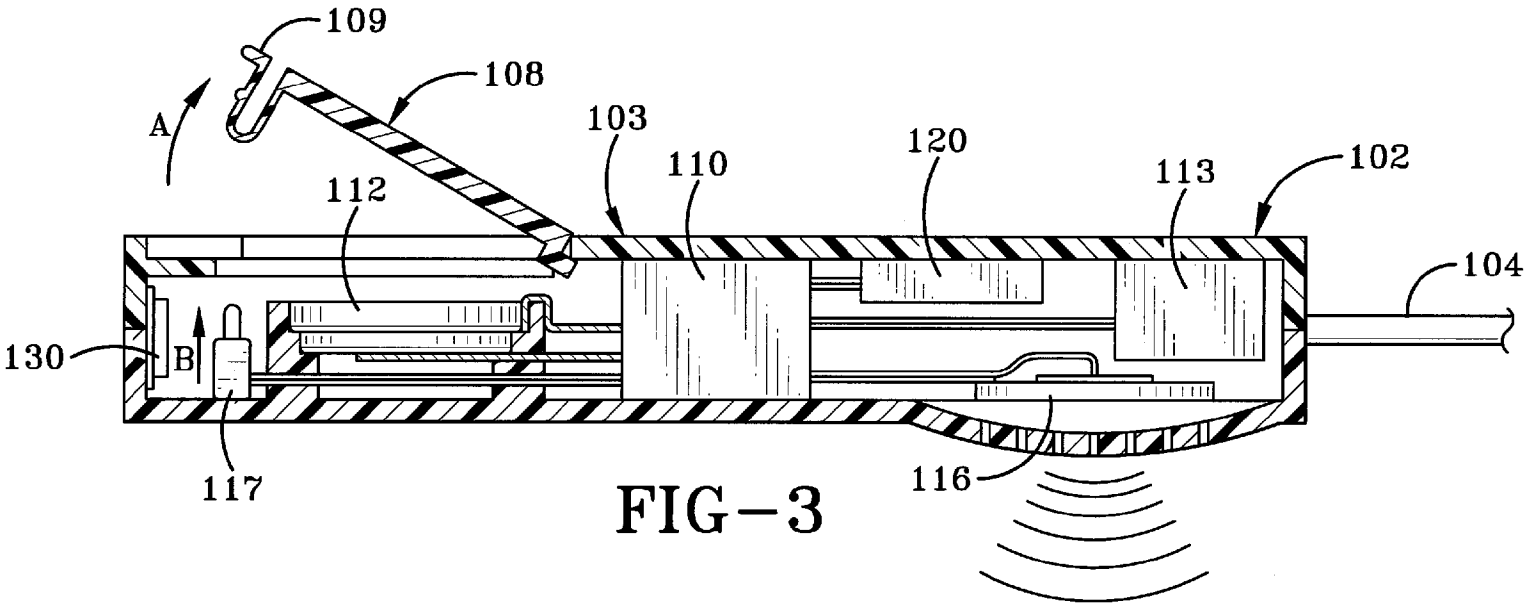
FIG. 3 is a sectional view the same as FIG. 2 with the cable-lock door in the open position.

FIG. 1 illustrates the security device of the present invention indicated generally at 100 incorporated in a device, such as a cable-lock 102. Cable-lock 102 includes a housing body 103 and a cable 104 for placement about an item of merchandise. One end of the cable 104 can be permanently attached to the housing body 103 and the other end either locked to the housing body 103 or unlocked from the housing body 103. As shown in FIG. 1, cable 104 is placed around the handle 106 of a briefcase or other article and is locked back into the housing body 103 so that the cable-lock 102 cannot be removed from the briefcase. Housing body 103 includes an access door 108 with a tab button 109 (FIGS. 2 and 3). The access door 108 can be easily opened by simply depressing the button 109. No screws or other fasteners need to be physically removed to open door 108.

Security device 100 can also include a key 121 for deactivating an internal alarm within cable-lock 102. The key 121 can be any key that can deactivate the alarm and can be used in combination with a key sensor 120 (FIGS. 2 and 3) discussed below. For example, the key could be an electronic key that emits electromagnetic radiation that the sensor 120 can detect when the key 121 is in proximity of the sensor 120. Alternatively, key 121 can be a magnet that can magnetically/mechanically deactivate the alarms. The key 121 can be another type of key as understood by those of ordinary skill in the art for deactivating the alarm system of the cable-lock 102.

FIGS. 2 and 3 illustrate the inside components of the cable-lock 102. The cable-lock 102 includes an alarm control logic 110. "Logic", as used herein, includes but is not limited to hardware, firmware, instructions stored or in execution on a machine, and/or combinations of each to perform a function(s) or an action(s), and/or to cause a function or action from another logic, method, and/or system. Logic may include a software controlled microprocessor, a discrete logic (e.g., ASIC), an analog circuit, a digital circuit, a programmed logic device, a memory device containing instructions, and so on. Logic may include at least one circuit, one or more gates, combinations of gates, or other circuit components. Where multiple logical logics are described, it may be possible to incorporate the multiple logical logics into one physical logic. Similarly, where a single logical logic is described, it may be possible to distribute that single logical logic between multiple physical logics A primary power source 112 and a secondary power source 113 are connected to the alarm control logic 110. The primary power source 112 can be a battery and the secondary power source 113 can be a large capacitor (e.g., megacap) or another smaller battery. The alarm control logic 110 is configured to receive its power from the primary power source 112 until its voltage falls below a threshold value. When this happens, the alarm control logic 110 is configured to switch to the secondary power source 113.

In the cable-lock embodiment, the alarm control logic 110 can also be connected to other devices in cable-lock 102 useful in the operation of the cable-lock. For example, alarm control logic 110 is connected to a door sensor 117 by a switch or another type of device that can detect when the access door 108 is open. Alarm control logic 110 is also connected to an audio speaker 116. The cable-lock also may contain other security devices such as an EAS tag 130.

Having described the components of cable-lock 102, its operation is now discussed. In operation, the primary power source 112 is used to power the alarm control logic 110 and other electronic devices in the cable-lock 102. The secondary power source 113 is used as a backup to the primary power source 112, such as when the primary power source 112 loses some of its charge and needs to be replaced. Before the charge from primary power source 112 is insufficient to power the cable-lock 102, the alarm control logic 110 will switch to the secondary power source 113 and use this power for its power needs. In some embodiments, this may be a smaller power source but will provide time necessary to change the primary power source 112. There may be an LED (not shown) that the alarm control logic 110 can cause to blink when it has switched to the secondary power source 113 to provide an indication that the primary power source 112 has failed and needs to be replaced.

In operation, a store employee can take the cable-lock 102 and attach it to a merchandise item by wrapping the cable 104 around or through a merchandise item and then locking both ends of the cable 104 into the housing body 103. As previously mentioned, one cable end may be permanently attached the housing body 103. The other end may contain a plug that is slid into the housing body 104 and locked inside by a mechanical type of locking mechanism as understood by those of ordinary skill in the art that can be opened with a magnetic key or another mechanism. In one configuration, the sliding and locking of the cable 104 to the housing body 103 activates the alarm system.

When the alarm system is activated, the merchandise item with the cable-lock 102 securely attached to it can be securely placed in a retail setting. Consumers can now handle the merchandise item and become acquainted with the item before purchasing the item. The retail establishment can rest assured that the merchandise item is secure due to one or more alarms monitored by the alarm control logic 110.

A variety of alarms can be monitored and alarm signals generated by the alarm control logic 110. For example, when the cable 104 is severed, an electrical pathway passing through the cable 104 is opened. The alarm control logic 110 detects this open circuit and can generate an audible alarm using the speaker 116, flash LEDs, send electronic messages or generate other alarm indications. Alternatively, a thief may try to open the access door 108 to quickly remove the primary power source 112 (battery) in an attempt to disable the entire alarm system. When the access door 108 is opened, the door sensor 117 is decompressed and the alarm control logic 110 can detect this and generate an appropriate alarm. Even when the primary power source 112 is quickly removed, the secondary power source 113 which is not readily accessible through open door 108, can still operate the alarm system and generate alarm indicators. The EAS tag 130 provides another level of security. When the cable-lock 102 is brought within range of an alarm gate near an exit, the alarm gate will sense the EAS tag 130 and sounds an alarm.

When the primary power source 112 needs to be replaced, an authorized person can bring the electronic key 121 in proximity of the key sensor 120 so that the alarm control logic 110 can securely disable the alarm. Of course, the alarm system can be deactivated in other ways as understood by those with ordinary skill in the art. When the system is disabled, the access door 108 can be opened by merely pressing the tab button 109 and opening the access door 108. No screws need to be removed and no other tools may be needed. With the access door 108 open, the primary power source 112 can be replaced. After replacement, the alarm system can be rearmed by again engaging the key sensor 120 with the key 121, pressing an activation button, or by another method as understood by those of ordinary skill in the art.

At the time of purchase, a cashier may deactivate the system with the key 121 and remove at least one end of the cable 104 from the housing body 103 and removed the cable lock 102 from the merchandise item. The cable-lock 102 can be kept in deactivated state until it is re-attached to a different merchandise item and reused.

Figure 4:
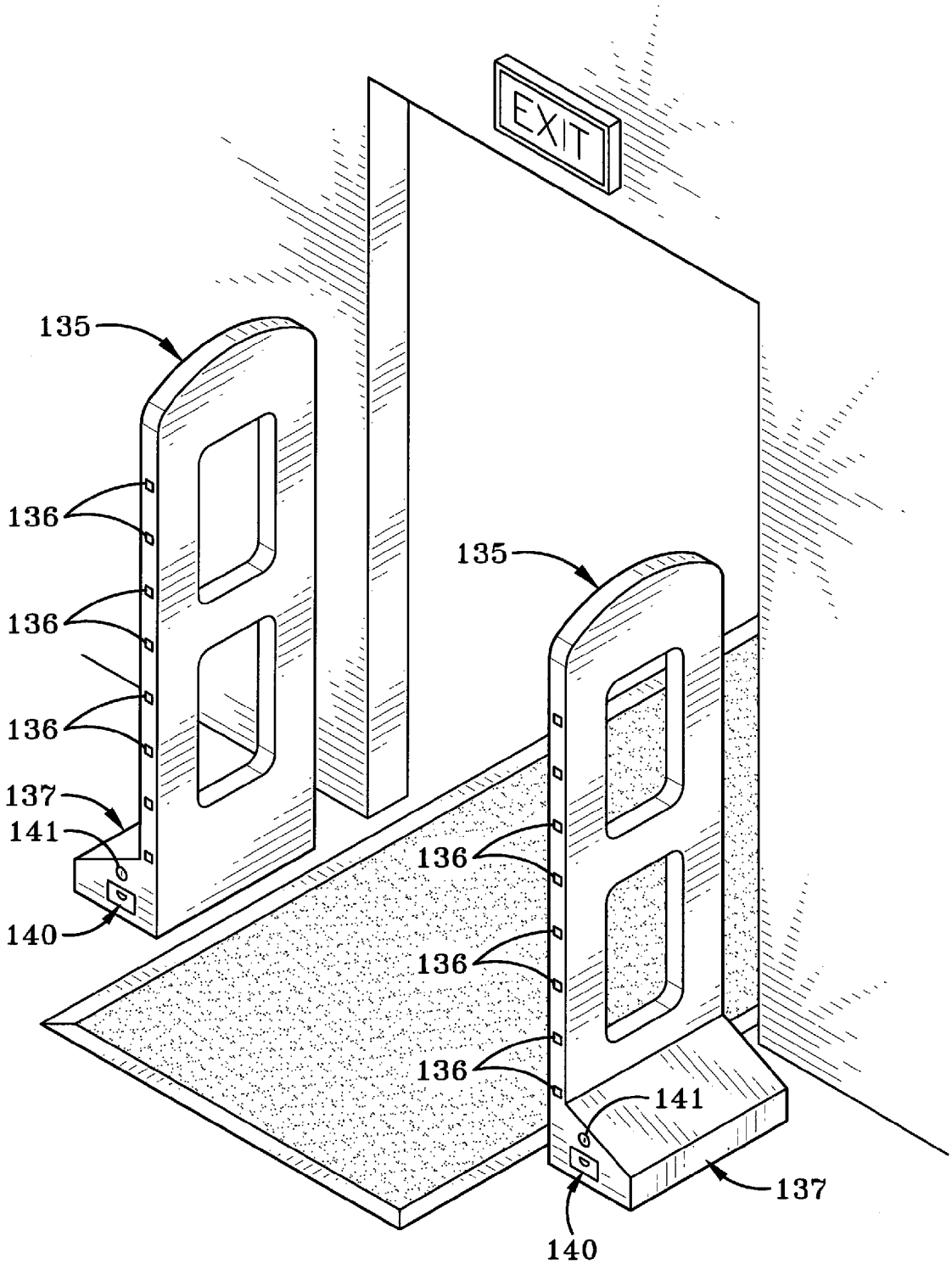
FIG. 4 is a perspective view showing the security device of the present invention embodied in a security gate.

FIG. 4 illustrates another security system or device in which the security device of the present invention may be incorporated, which is a security gate 135 stationed near an exit door of a retail establishment. The security gates 135 include base units 137 for providing support to elongated antenna units inside the gates 135, alarm indicators 136 (lights), powers supply drawers 140 and lock units 141. In one embodiment, the drawer can be easily opened without removing screws or using other tools to allow batteries powering a gate 135 to be more easily removed than in a prior art gate. The lock unit 141 is shown in FIGS. 5-8 as a mechanical lock unit activated with a manually operated key 142. However, the lock units may be electronic key/sensor combinations as discussed above with reference to FIGS. 1-3 or another kind of lock unit. Even though the power supply drawers 140 are generally horizontal as illustrated in FIGS. 5-8, in other configurations the power supply drawers could be vertical to supply a gate such as Checkpoint System's NanoGate® type of security gates.

FIGS. 5-8 illustrate the internal components of a security gate 135. Similar to the cable-lock 102 discussed earlier, there is a primary power source or power supply 150 and secondary power source or supply 151 connected to an alarm control logic 152. The power sources 150 and 151 can be any power source that can supply voltage and current to the alarm control logic 152. For example, the primary power source 150 can be one or more "D" size batteries and the secondary power source 151 can be a large or mega-capacitor or smaller size battery.

Figure 5:
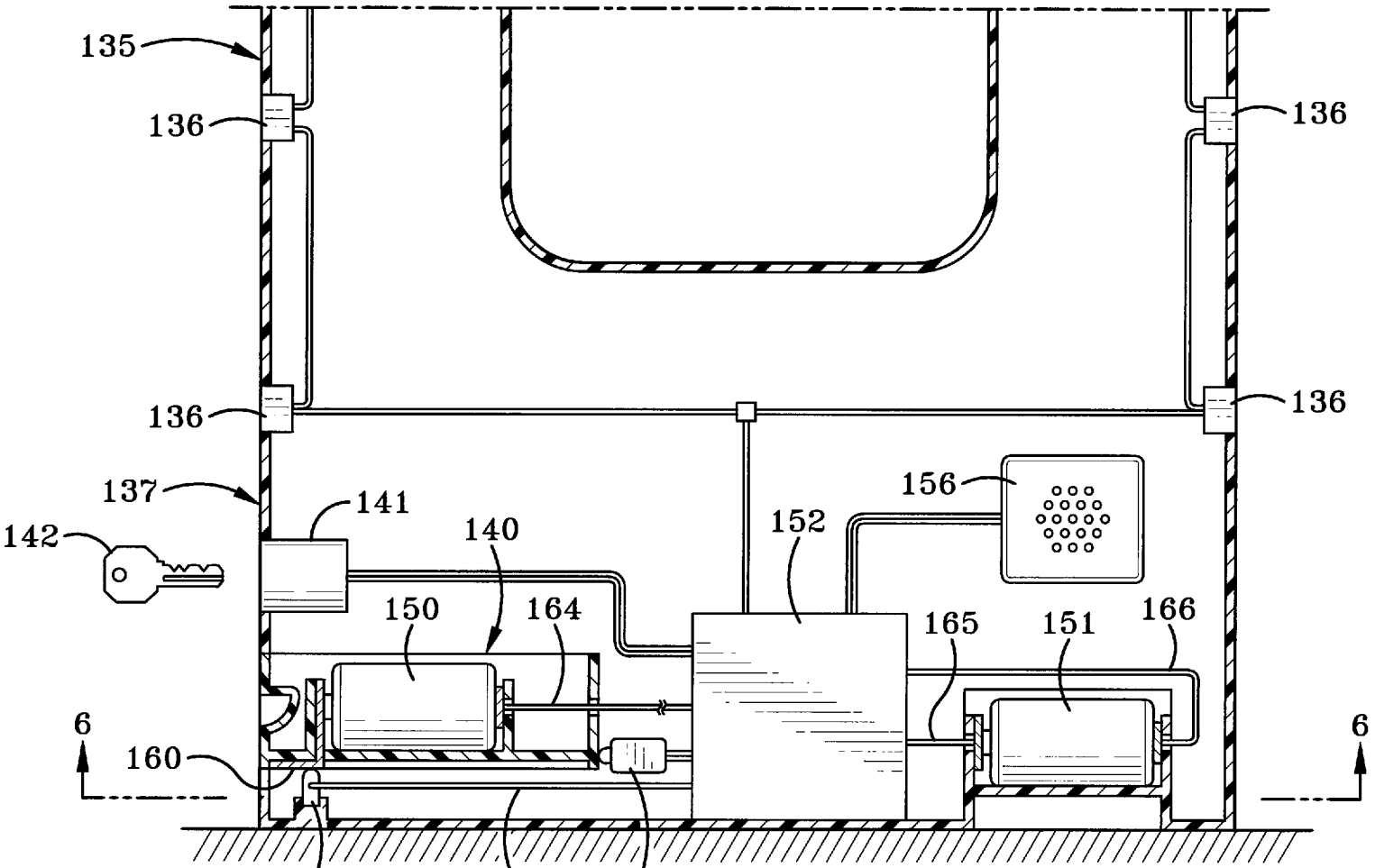
FIG. 5 is a sectional view of the lower portion of the security gate of FIG. 4.

The lock unit 141 as well as a speaker 156 is connected to the alarm control logic 152. A switch 155, which is a plunger switch in the embodiment shown in the drawings, is located so that it is depressed when the drawer is in the closed position as shown in FIG. 5.

Figure 6:
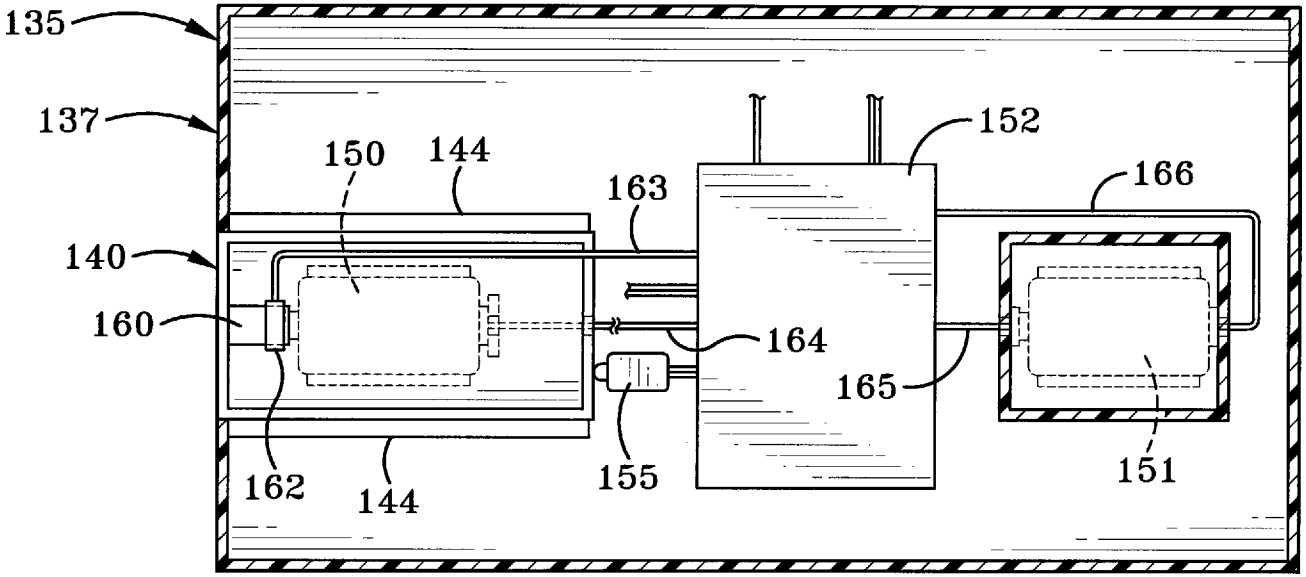
FIG. 6 is a sectional view taken on line 6-6, FIG. 5.
Figure 7:
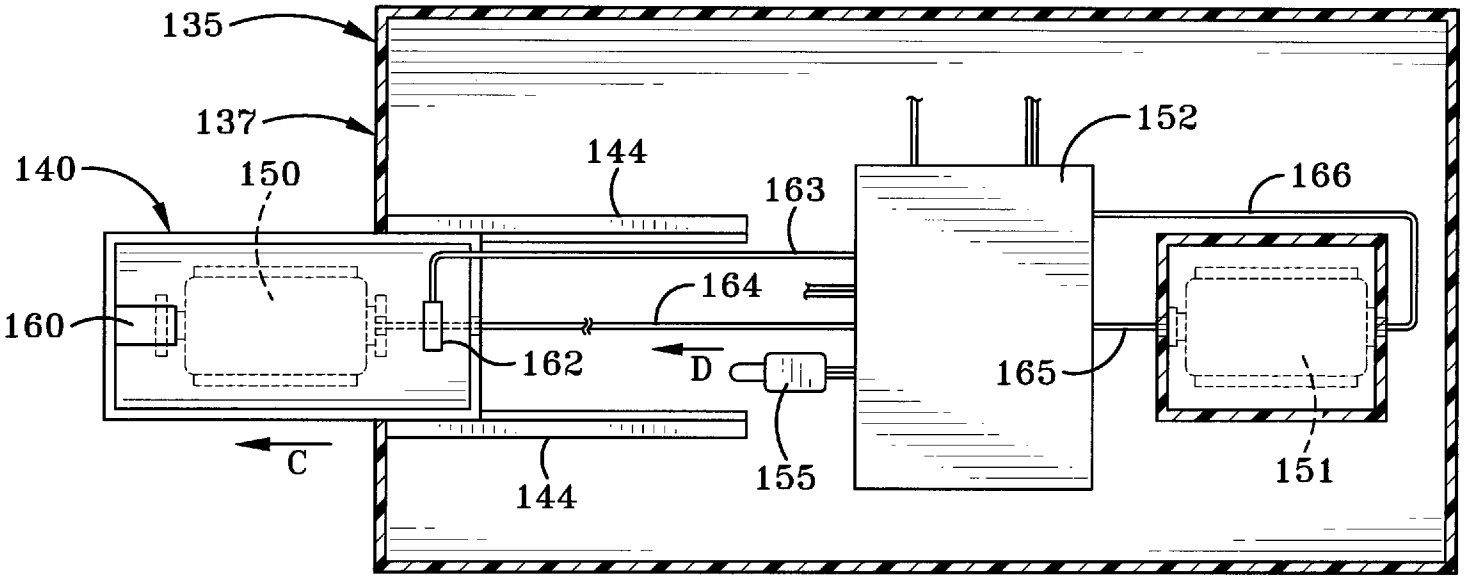
FIG. 7 is a sectional view the same as FIG. 6 with the power supply drawer in the open position.

FIGS. 6 and 7 illustrate bottom views of power source drawer 140 in the closed and open positions, respectively. The drawer is supported between slider support walls 144. A primary contract strip 160 is connected by wire 163 to a first terminal of the primary power source 150. Another wire 164 connects a second terminal of the primary power source 150 to the security control logic 152. A contact pin 162 makes contact with primary contact strip 160 when the drawer is in the closed position. A pair of wires 165 and 166 connect first and a second terminals of the secondary power source 151 to the alarm control logic 152.

Figure 8:
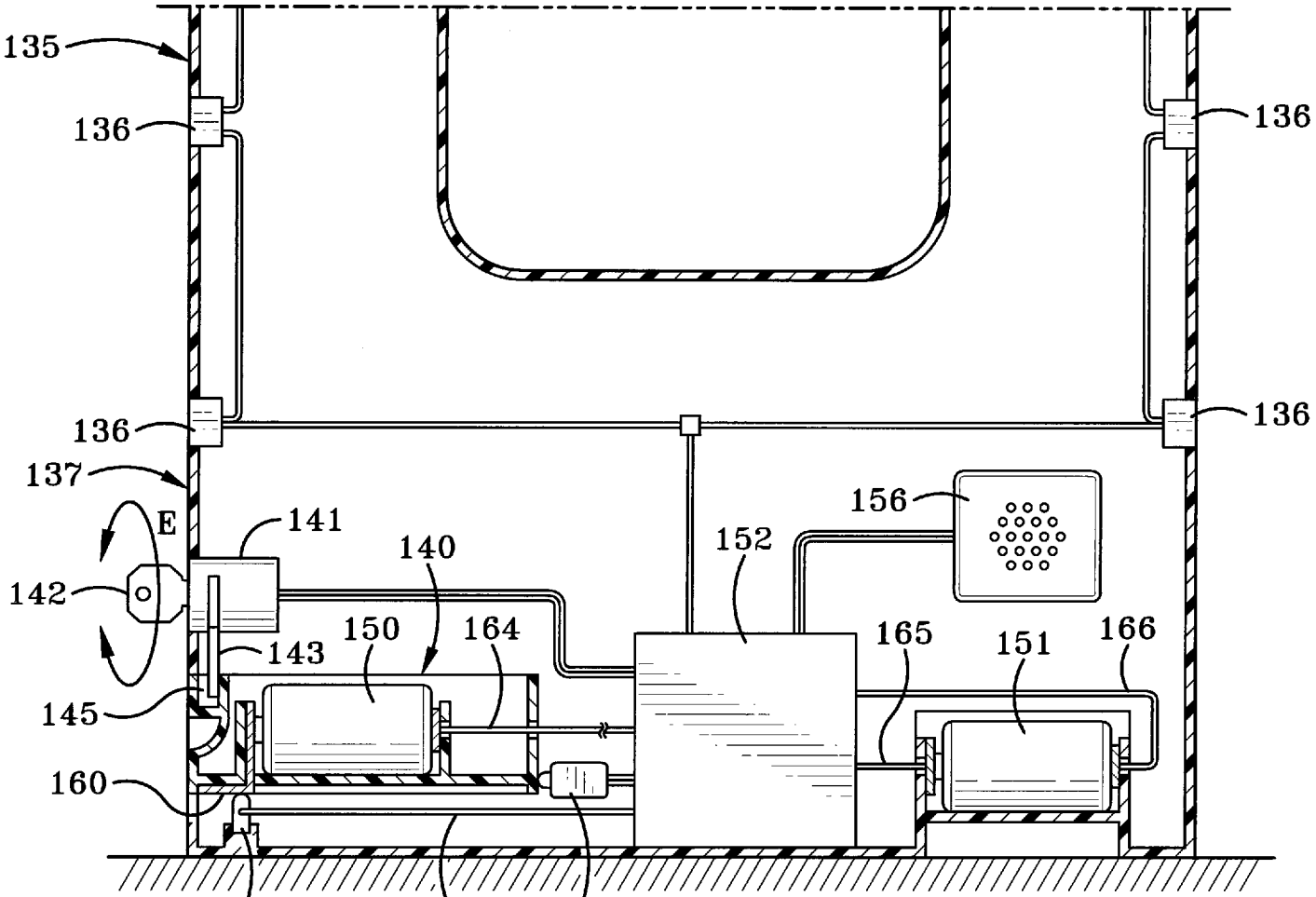
FIG. 8 is a sectional view the same as FIG. 5 with the power supply drawer in a closed locked position.

The lock unit 141 is illustrated in FIG. 8 as having a locking arm 143 which is received within a lock arm reception area 145 formed in drawer 140 for locking drawer 140 in the closed locked position.

Having described the structure of the security gate 135 with a drawer 140, its operation will now be discussed. In normal operation, the security gates 135 will be powered up continually sensing to determine when a device with an EAS tag is within proximity or passing through the gates 135. For example, when a cable-lock 102 such as shown in FIGS. 1-3, is brought within proximity of security gate 135, an EAS tag 130 within the cable-lock 102 will be sensed by the gate 135 and the alarm control unit 152 will then sound alarms and blink the lights 136 on the gate.

During normal operation, the electronics within the gate 135 are normally powered by the primary power source 150. However, when power source 150 fails or its voltage drops past a predetermined threshold value, the alarm control unit 152 will switch to the secondary power source 151. Example circuits in the alarm control unit 152 that make this switch are discussed below with reference to FIGS. 11 and 12.

When the primary power source 150 needs changed, an authorized person can unlock the lock unit 141 using a key 142 to rotate the key as shown by arrow E in FIG. 8. There may be an electrical connection between the lock 141 and the alarm control unit 152 so that the alarm control unit 152 can detect that the lock 141 is now unlocked and so the alarm control unit can shut down the alarm system while the primary power supply 150 is being replaced. Next, an authorized person can easily slide the drawer 140 open in the direction of Arrow C as shown in FIG. 7 and replace the primary power source 150. The drawer 140 can easily be opened without removing any screws or other fastening device. Also, as shown in FIG. 7, when drawer 140 is pulled exteriorly of the housing secondary power source 151 is inaccessible preventing unauthorized tampering. The drawer 140 may have an opening button or tab (not shown) that may need lightly pressed in order to open the drawer 140. After the power source 150 is replaced, the drawer 140 can be closed and the lock 141 relocked to again arm the gate 135.

When the drawer 140 is pulled out, the alarm control unit 152 and other electronics in the gate 135 can still be powered by the secondary power source 151. Normally the alarm control unit 152 and other electronics are powered by the primary power source 150 through wires 163 and 164. Wire 163 is connected to the primary power source through the contact pin 162 and contact strip 160 (FIG. 6). However, when the drawer 140 is slid open, the contract strip 160 is pulled away from the contact pin 162 (FIG. 7) to open this circuit so that the primary power source 150 is no longer able to supply power. The alarm control unit 152 detects this and begins to use power form the secondary power source 151.

If, however, someone tries to open the drawer 140 by sliding it open without deactivating the alarm control unit 152 by unlocking the lock 141, then the alarm unit will detect that the drawer 140 is being opened because the plunger switch 155 will open as shown in FIG. 7. When the switch 155 opens and the lock has not been unlocked, the alarm control unit 152 will assume that an unauthorized opening of the drawer 140 is occurring and will generate appropriate alarms. Even if the primary power source 150 is removed, the alarm control unit 152 can still generate alarms by switching to the secondary power source 151 to receive power from it through wires 165 and 166.

Figure 9:
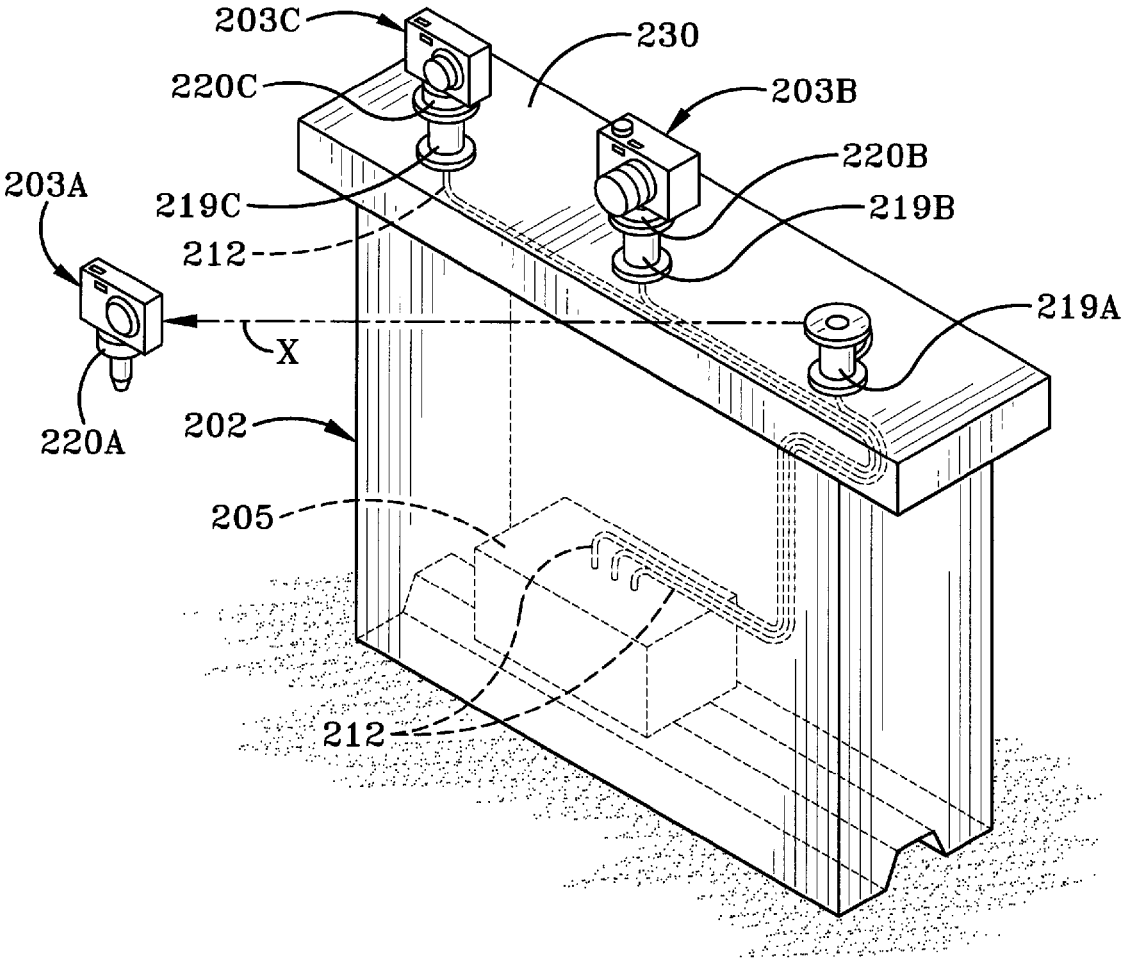
FIG. 9 is a perspective view of the invention embodied in a merchandise display stand.

FIG. 9 illustrates a merchandise display stand 202 having the security device of the present invention incorporated therein. The display stand includes a display stand surface 230. Several pedestal assemblies 219A, 219B, 219C are mounted to the display stand surface 230. Wireless alarm units 220A, 220B, 220C are attached to the underside of merchandise items 203A, 203B, 203C displayed at the merchandise display 202. The merchandise items 203A, 203B, 203C are illustrated as being cameras; however, they can be other devices such as cellular telephones or other products. The wireless alarm units 220A, 220B, 220C are configured so that they can be placed into a corresponding pedestal assemblies 219A, 219B, 219C, respectively, so a merchandise item 203A, 203B, 203C is displayed to a consumer. This allows a consumer to handle and inspect merchandise items 203A, 203B, 203C before purchasing the item. For example, a consumer may remove merchandise item 203A and with its wireless alarm unit 220A from its corresponding pedestal assembly 219A as indicated by arrow "X".

As discussed in detail above, the preferred embodiment of the invention includes a primary power supply and a secondary power supply. For example, these two power supplies can be included in each of the wireless alarm units 220A, 220B, 220C attached to each corresponding merchandise items 203A, 203B, 203C. Initially, alarm circuits inside the wireless alarm units 220A, 220B, 220C would be powered by the primary power supplies. Again, if the primary power supply loses power, the alarm circuits are still powered by a secondary power supply. The alarm circuits can be used to generate an alarm if the wireless alarm units 220A, 220B, 220C are removed from the corresponding merchandise items 203A, 203B, 203C or if the corresponding merchandise items 203A, 203B, 203C are moved too far away from the merchandise display 202. Alternatively, the alarm units 220A, 220B, 220C can be configured to generate an alarm when moved within a predetermined distance of a security gate located near a door.

The merchandise display stand 202 can include a power supply 205 for supplying power through cables 212 to the wireless alarm units 220A, 220B, 220C when the wireless alarm units 220A, 220B, 220C are resting on corresponding pedestal assemblies 219A, 219B, 219C. For example, when the primary and secondary power supplies in the wireless alarm unit 220A are batteries, then the batteries can be charged and the alarm unit 220A can be powered through a cable 212 when it is resting on its corresponding pedestal assembly 219A.

Figure 10:
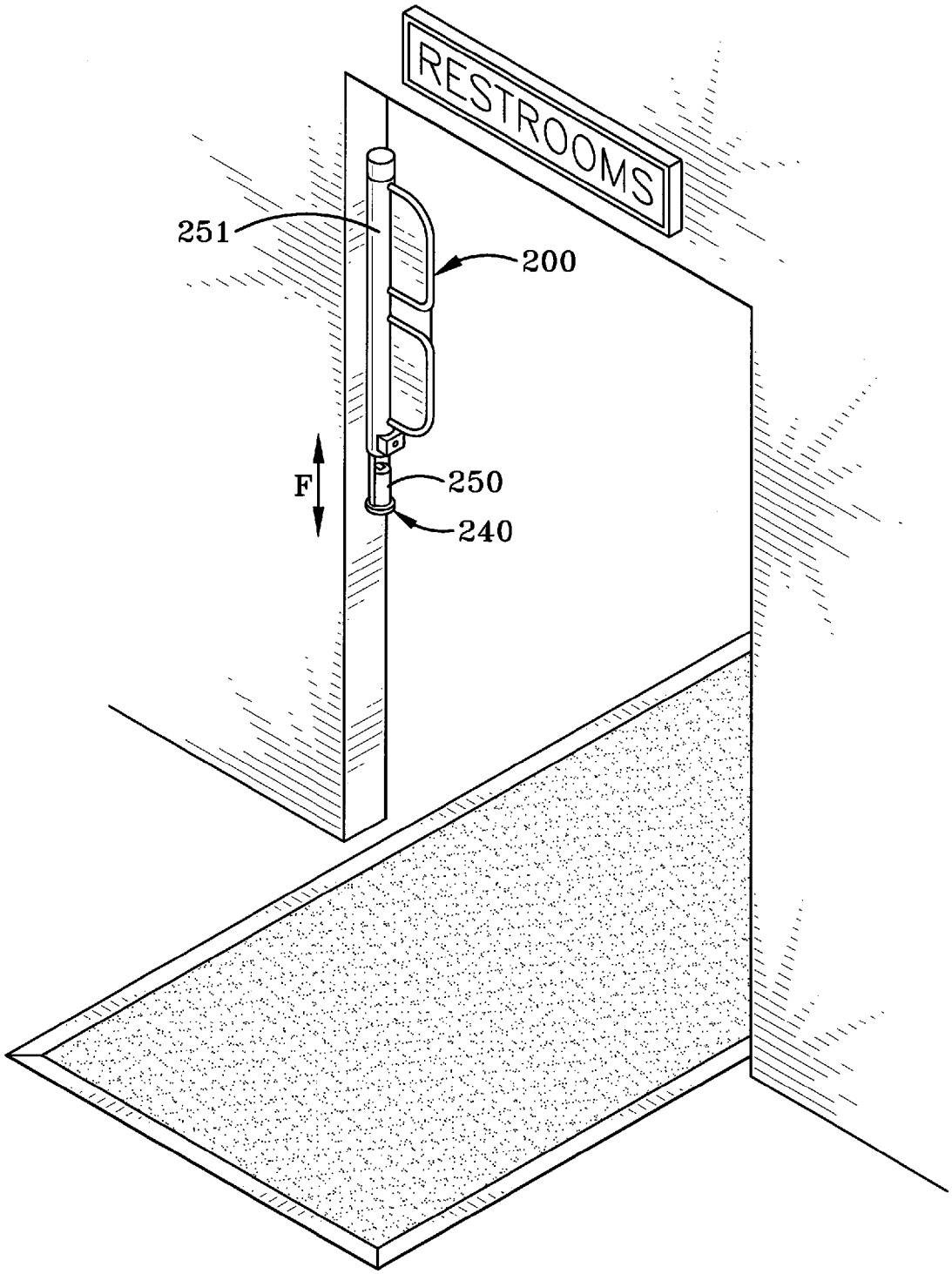
FIG. 10 illustrates another embodiment of the invention embodied in another type of security gate.

FIG. 10 illustrates another configuration in which the security device of the present invention may be incorporated which is a security gate 200 stationed near a restroom entrance door. The security gate 200 includes a base unit 251, a power supply drawer 240 for storing a primary power source 250 and an internal secondary power supply or source (not shown). The base unit 251 provides support to elongated antenna units projecting from the gate 200. In one embodiment, the drawer 240 can be easily opened without removing screws or using other tools to allow batteries 250 powering the gate 200 to be more easily removed than in prior art gates. The power supply drawer 240 can be vertically inserted and removed from the bottom of the gate 200 as shown by arrow F. The gate may be a gate such as Checkpoint System's NanoGate® type of security gates. The gate 200 can be activated/deactivated with a key and contain other components as described below with reference to FIGS. 6-9 that illustrate more traditional security gates.

Figure 11:
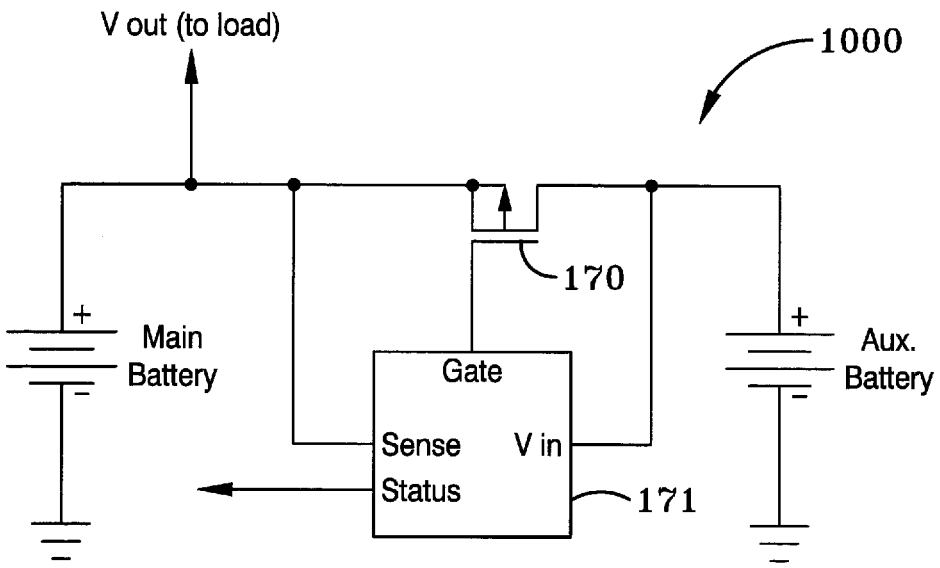
FIG. 11 is a schematic view of a switch logic of the preferred embodiment of the invention.
Figure 12:
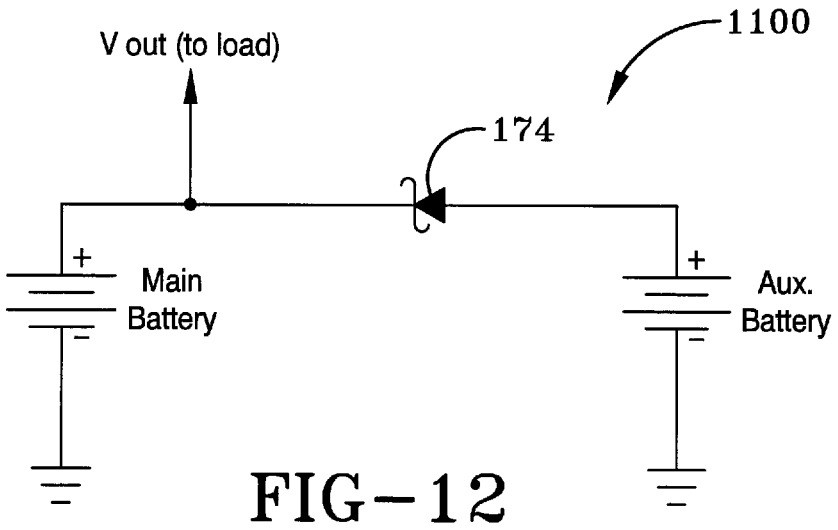
FIG. 12 is a schematic view of another switch logic of the preferred embodiment of the invention.

FIGS. 11 and 12 illustrate two example circuits that can be used to switch between a main battery (primary power source) and an auxiliary battery (secondary power source). A circuit 1000 in FIG. 11 includes main and auxiliary batteries, a transistor and control logic 171. The control logic 171 includes a status output, a sense input, a gate output and a voltage input line (Vin).

In operation, the voltage input line is used to power the control logic 171 with the auxiliary battery. In normal operation, the gate output voltage from the sensor logic 171 is low to open the source and drain of the transistor so that the auxiliary battery does not supply power to a load (Vout). Instead, the main battery is connected to and supplies power to the load. The control logic 171 senses the voltage supplied to the load by the main battery through input sense. If this voltage drops below a threshold value, then it is likely that the main battery has failed or can no longer supply adequate power. The control logic 171 can sense this condition and supply a voltage to the transistor 170 to turn it on and connect the auxiliary battery to the load (Vout). When this occurs, the control logic 171 can also output a signal to alert that the auxiliary battery is now being used. For example, the control logic 171 can output a voltage to turn on an LED (not shown).

The circuit 1100 of FIG. 12 includes a main battery (primary power source), an auxiliary battery (secondary power source), a diode 174 and an output to a load. The diode 174 may be a Schottkey diode that can turn on with small drops in voltage. In primary operation, the main battery supplies enough voltage so that the diode 174 does not turn on and the auxiliary battery is not connected to the load. However, if the voltage that the main battery is supplying to the load drops below a threshold value, then the diode 174 turns on connecting the auxiliary battery to the load so that the auxiliary battery is now supplying power to the load.

Example methods may be better appreciated with reference to a flow diagram. While for purposes of simplicity of explanation, the illustrated methodologies are shown and described as a series of blocks. It is to be appreciated that the methodologies are not limited by the order of the blocks, as some blocks can occur in different orders and/or concurrently with other blocks from that shown and described. Moreover, less than all the illustrated blocks may be required to implement an example methodology. Blocks may be combined or separated into multiple components. Furthermore, additional and/or alternative methodologies can employ additional, not illustrated blocks.

Figure 13:
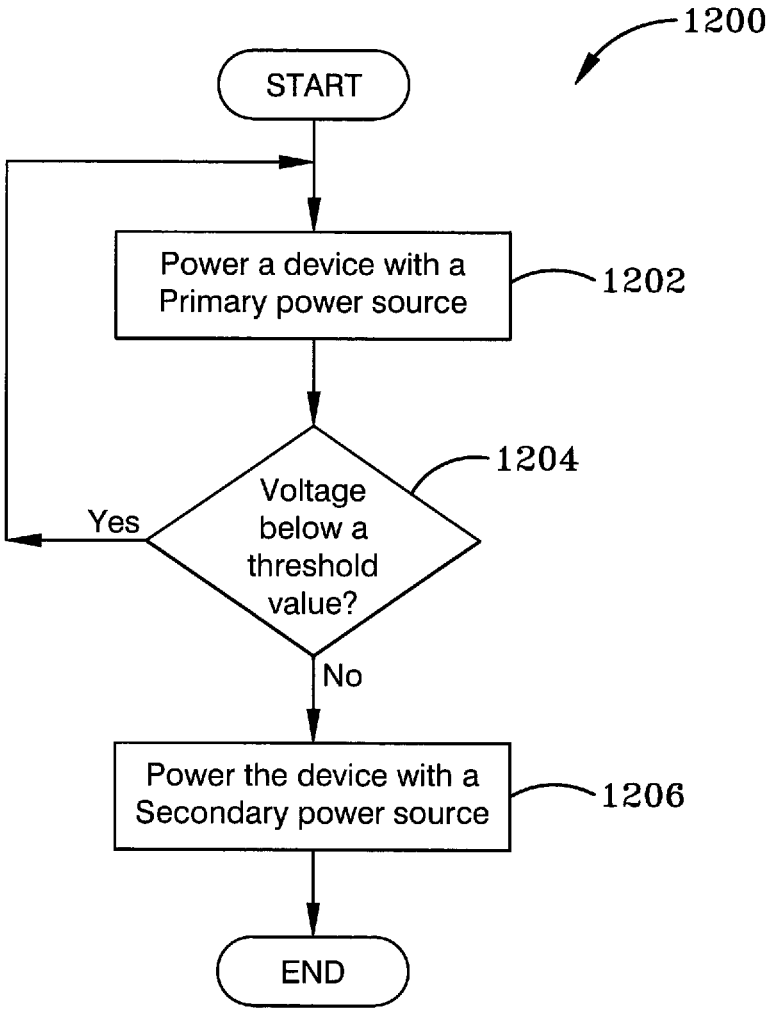
FIG. 13 is a flow diagram of a method of switching from a primary power source to an auxiliary power source.

A method for switching from a primary power source to a secondary power source is illustrated in FIG. 13 as a flow diagram 1200. The method begins by powering a device such as a cable-lock, spider wrap or another device protecting a merchandise item with the primary power source (battery) indicated by block 1202. A determination is made at 1204, to determine if a voltage supplied by the primary power source has fallen below a threshold value. If not the primary power source is still used to power the device. If the threshold voltage is crossed, then the device is switched to the secondary power source so that the secondary power source can power the device, at 1206.

In other configurations of the method, a determination could be made to see if the alarms of the device were securely disabled. If so, then the alarm will not sound when the primary power source is replaced. If not, then an alarm can be sounded when an access door to the primary power source and a tray holding the primary power source is opened.

In the foregoing description, certain terms have been used for brevity, clearness, and understanding. No unnecessary limitations are to be implied therefrom beyond the requirement of the prior art because such terms are used for descriptive purposes and are intended to be broadly construed. Therefore, the invention is not limited to the specific details, the representative embodiments, and illustrative examples shown and described. Thus, this application is intended to embrace alterations, modifications, and variations that fall within the scope of the appended claims.

Moreover, the description and illustration of the invention is an example and the invention is not limited to the exact details shown or described. References to "the preferred embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in the preferred embodiment" does not necessarily refer to the same embodiment, though it may.

What is claimed is:

1. A merchandise display stand, comprising:

a display stand surface;

a pedestal assembly mounted to the display stand surface;

an alarm unit configured to attach to a merchandise item, wherein the alarm unit is further configured to communicate with the pedestal assembly;

a power supply coupled with the alarm unit, the power supply including a primary power supply having a primary charge and a secondary power supply having a secondary charge, wherein the alarm unit is configured to transfer the power supply from the primary power supply to the secondary power supply prior to the primary charge being insufficient to power the alarm unit;

an enclosure having an access door, the primary power supply positioned within the enclosure; and a door sensor for detecting movement of the access door from a closed position, wherein an alarm unit is configured to generate the alarm when the door sensor detects the movement of the access door.

2. The merchandise display stand defined in claim 1, wherein the alarm unit communicates with the pedestal assembly via a wireless transmission.

3. The merchandise display stand defined in claim 1, wherein the alarm unit generates the alarm when any of the following conditions occur: the alarm unit is detached from the merchandise item, the alarm unit is moved a predefined distance from the merchandise display stand, or the alarm unit is moved within a predefined distance of a security gate.

4. The merchandise display stand defined in claim 1, wherein the power supply is supplied to the pedestal assembly via a cable, and the alarm unit receives the power supply when the alarm unit is physically coupled to the pedestal assembly.

5. The merchandise display stand defined in claim 1, wherein the alarm unit is powered by the primary power supply when the primary power supply has sufficient power, and the alarm unit is powered by the secondary power supply when the primary power supply has insufficient power.

6. The merchandise display stand defined in claim 1, wherein the primary power supply and the secondary power supply are batteries.

7. The merchandise display stand defined in claim 1, wherein the primary power supply or the secondary power supply is charged when the alarm unit is resting on the pedestal assembly.

8. The merchandise display stand of claim 1, further comprising:

a lock unit electrically connected to the alarm unit, wherein the alarm unit is configured to shut down when the lock unit is unlocked.

9. The merchandise display stand of claim 1, wherein the secondary power supply is not accessible within the enclosure.

10. A method of protecting an item of merchandise, comprising the step of:

providing a display stand surface;

mounting a pedestal assembly to the display stand surface;

attaching an alarm unit to a merchandise item;

coupling the alarm unit to the pedestal assembly;

coupling a power supply with the alarm unit, the power supply including a primary power supply having a primary charge and a secondary power supply, wherein the alarm unit is configured to transfer the power supply from the primary power supply to the secondary power supply prior to the primary charge being insufficient to power the alarm unit;

positioning the primary power supply within an enclosure having an access door;

detecting movement of the access door from a closed position with a door sensor; and generating an alarm when the door sensor detects the movement of the access door.

11. The method of claim 10, wherein the alarm unit communicates with the pedestal assembly via a wireless transmission.

12. The method of claim 10, further comprising the step of generating the alarm, via the alarm unit, when any of the following conditions occur: the alarm unit is detached from the merchandise item, the alarm unit is moved a predefined distance from the merchandise display stand, or the alarm unit is moved within a predefined distance of a security gate.

13. The method of claim 10, wherein the alarm unit generates an audible alarm.

14. The method of claim 10, further comprising supplying the power supply to the pedestal assembly via a cable, wherein the alarm unit receives the power supply when the alarm unit is physically coupled to the pedestal assembly.

15. The method of claim 10, further comprising powering the alarm unit by the primary power supply when the primary power supply has sufficient power, and powering the alarm unit by the secondary power supply when the primary power supply has insufficient power.

16. The method of claim 15, wherein the primary power supply and the secondary power supply are batteries.

17. The method of claim 10, further comprising the step of charging the primary power supply or the secondary power supply when the alarm unit is resting on the pedestal assembly.

18. A merchandise security system, comprising:

an alarm unit configured to attach to a merchandise item;

a security gate configured to sense when the alarm unit is within a proximity of the security gate; and a merchandise display stand, comprising:

a display stand surface, a pedestal assembly, wherein the pedestal assembly is configured to communicate with the alarm unit;

a power supply including a primary power supply having a primary charge and a secondary power supply, wherein the power supply is coupled to the alarm unit and the power supply is transferred from the primary power supply to the secondary power supply prior to the primary charge being insufficient to the power alarm unit;

an enclosure having an access door, the primary power supply positioned within the enclosure; and a door sensor for detecting movement of the access door from a closed position, wherein an alarm unit is configured to generate the alarm when the door sensor detects the movement of the access door.

19. The merchandise security system defined in claim 18, wherein the pedestal assembly communicates with the alarm unit via a wireless transmission.

20. The merchandise security system defined in claim 18, wherein the alarm unit generates the alarm when any of the following conditions occur: the alarm unit is detached from the merchandise item, the alarm unit is moved a predefined distance from the merchandise display stand, or the alarm unit is moved within a predefined distance of the security gate.

21. The merchandise security system defined in claim 18, wherein power is supplied to the pedestal assembly via a cable, and the alarm unit receives the power supply when the alarm unit is physically coupled to the pedestal assembly.

* * * * *